United States Patent [19]

Takiguichi et al.

[11] 4,078,286

[45] Mar. 14, 1978

[54] HEAT FIXING ROLL FOR ELECTROPHOTOGRAPHIC DUPLICATORS

[75] Inventors: Koichi Takiguichi, Fairport, N.Y.; Teruhiko Itami, Ebina, Japan; Shigeru Sadamatsu, Ebina, Japan; Ashihiko Yamada, Ebina, Japan; Masakatsu Kimura, Ebina, Japan

[73] Assignee: Rank Xerox Ltd., London, England

[21] Appl. No.: 777,500

[22] Filed: Mar. 14, 1977

[30] Foreign Application Priority Data

Mar. 15, 1976 Japan ..... 51-027044

[51] Int. Cl.[2] ..... B21B 31/08

[52] U.S. Cl. ..... 29/132

[58] Field of Search ..... 29/132, 130

[56] References Cited

U.S. PATENT DOCUMENTS

| | | | |
|---|---|---|---|
| 3,686,731 | 8/1972 | Koori et al. | 29/132 |
| 3,795,033 | 3/1974 | Donnelly et al. | 29/132 |
| 3,988,817 | 11/1976 | Thettu | 29/132 X |
| 3,997,691 | 12/1976 | Murphy | 29/132 X |
| 4,000,339 | 12/1976 | Murphy | 29/132 X |

*Primary Examiner*—Alfred R. Guest

*Attorney, Agent, or Firm*—James J. Ralabate; Ernest F. Chapman

[57] ABSTRACT

Silicone rubber is employed as an outer coating material on a fuser member and is applied to the base member by means of a novel construction which prevents the separation of the outer silicone rubber coating from the roll even when silicone oil is applied thereto. The fuser member comprises a base member, a layer of a heat-resistant resin formed on the base member and a layer of a silicone rubber formed on the heat-resistant resin layer, the silicone rubber being vulcanized after the formation of the layer of silicone rubber on the resin layer. A primer layer may be used between the heat-resistant resin layer and the silicone rubber layer.

9 Claims, 5 Drawing Figures

HEAT FIXING ROLL FOR ELECTROPHOTOGRAPHIC DUPLICATORS

BACKGROUND OF THE INVENTION

This invention relates generally to members utilized for pressure fusing toners at elevated temperatures, and more particularly to improved heat fixing rolls for preventing offsetting of dry toners onto the roll during the fusing operation in electrophotographic duplicators.

In the process of electrophotographic duplication a light image of an original to be copied is typically recorded in the form of a latent electrostatic image upon a photosensitive member with subsequent rendering of the latent image visible by the application of electroscopic particles, commonly referred to as toner. The visual toner image can be either fixed directly upon the photosensitive member or transferred from the member to another support, such as a sheet of plain paper, with subsequent affixing of the image thereto. Toners are well known in the art and may be of various types.

In order to affix or fuse electroscopic toner material onto a support surface permanently by heat, it is necessary to elevate the temperature of the toner material to a point at which the constituents of the toner material coalesce and become tacky. This action causes the toner to flow to some extent into the fibers or pores of support sheets or member or otherwise upon the surface thereof. Thereafter, as the toner material cools, solidification of the toner material occurs causing the toner material to be bonded firmly to the support sheet or member. In both the xerographic as well as the electrograhic recording arts, the use of thermal energy for fixing toner images onto a support member is old and well known.

Several approaches to thermal fusing of electroscopic toner images onto a support have been described in the prior art and include providing the concomitant application of heat and pressure as by a roll pair maintained in pressure contact, a flat or curved plate member in pressure contact with a roll, a belt member in pressure contact with a roll, and the like. Heat may be applied by heating one or both of the rolls, plate members or belt members. The fusing of the toner takes place when the proper combination of heat, pressure and contact time are provided, the balancing of these parameters being well known in the art and varying according to various factors which must be independently determined for each particular situation.

During operation of a fusing system of the type where there is a thermal fusing of electroscopic toner images onto a support in which at least one fuser member, such as a roll, plate or belt, is heated, the support member to which the toner images are electrostatically adhered, it moved through the nip formed between the members with the toner image pressure contacting the fuser roll thereby to effect heating of the toner images within the nip. By controlling the heat transfer to the toner, virtually no offset of the toner particles from the copy sheet to the fuser member is experienced under normal conditions. This is because the heat applied to the surface of the fuser member is insufficient to raise the temperature of the surface of the member above the "hot offset" temperature of the toner at which temperature the toner particles in the image areas of the toner liquify and cause a splitting in the molten toner resulting in "hot offset." Splitting occurs when the cohesive forces holding the viscous toner mass together is less than the adhesive forces tending to offset it to a contacting surface such as a fuser roll, fuser belt, or fuser plate.

Occasionally, however, toner particles will be offset to the fuser roll by an insufficient application of heat to the surface thereof (i.e. "cold" offsetting); by imperfection in the properties of the surface of the roll; by the toner particles insufficiently adhering to the copy sheet; by the electrostatic forces which normally hold them there; or in certain cases by the reactivity of the toner material itself. In such as case, toner particles may be transferred to the surface of the fuser member with subsequent transfer to the backup member which provides pressure contact, during periods of time when no copy paper is in the nip.

In many of these pressure contact, heat fixing systems, a heated member, e.g. a roll, provided with a covering of a heat-resistant, releasing material on the outer surface thereof is contacted with a back-up or pressure roll covered with a heat-resistant, flexible material layer under nip pressure, between which the sheet to be fixed, is passed for fixing the toner image.

As an example of the heat-resistant, release material for the fuser member, there are well known materials such as polytetrafluoroethylene, silicone rubber, fluorocarbon elastomers and the like. In certain cases, a suitable off-set preventing liquid is fed onto the fuser member to minimize or avoid such problems as "offsetting." Silicone oils are widely applied as the off-set preventing liquid.

In the pressure contact heat fixing device of the type described above, the fuser member is covered with a certain thickness of heat-resistant silicone rubber which releases toner material and has an elastic, compressible surface. When silicone rubber is used as the outer layer of the fuser member, the fused image has excellent quality.

The silicone rubbers which can be used as the outer layer coating the base or core of the fuser member, can be classed into three groups according to vulcanization method and temperature, i.e., room temperature vulcanization-type silicone rubber, hereinafter referred to as RTV silicone rubber, low temperature vulvanization-type silicone rubber, hereinafter referred to as LTV rubber, and high temperature vulcanization-type silicone rubber, hereinafter referred to as HTV rubber. These silicone rubbers are well known in the art and are commercially available.

When employed as a fuser member covering material, the RTV and LTV silicone rubbers are generally superior in releasing property to the HTV silicone rubber and thus generally produce favorable results in fusing toner images. The RTV silicone rubbers now commercially available exhibit excellent release of toner images for about 5,000 to 30,000 copies fused by heat. Thereafter, there is a tendency for the off-set problem and winding of copying paper about the fuser roll to occur. When this occurs, it is necessary to replace the used fuser roll.

To overcome the foregoing problems it is well known that silicone oil may be applied to the surface of the fuser member (upon the silicone rubber layer) as an off-set preventing liquid during fixing operations. However, when silicone rubber is used as a heat-resistant, release layer to cover the fuser member, the use of a silicone oil is disadvantageous in that the silicone rubber is susceptible to swelling by the action of the silicone oil, so that the oil readily penetrates the rubber, resulting in separation of the rubber from a base or core.

Thus, the application of silicone oil is effective in improving the release characteristics but it sacrifices the durability of the silicone rubber layer covering the fuser member. For this reason, silicone rubber coated fuser members have a short life time and generally permit no more than about 30,000 fusing cycles per fuser member.

OBJECTS OF THE INVENTION

Accordingly, it is the principal object of this invention to provide a new and improved silicone rubber coated fuser member for use in fuser assemblies in xerographic duplicating machines which overcome the foregoing disadvantages.

Another object of the present invention is to provide a fuser member which has a heat resistant, silicone rubber surface layer or coating as a release material for toner images in which no separation occurs between the base or core and the silicone rubber layer when silicone oil is fed or metered on the silicone rubber.

Still another object of the invention is to provide a silicone rubber coated fuser member having an improved life.

SUMMARY OF THE INVENTION

The above-cited objects of the present invention are accomplished by a fusher member for pressure fusing toned electrostatic images at elevated temperatures, comprising a base member or core, a layer of a heat-resistant resin material coated on the base member or core surface and an outer layer of silicone rubber coated upon the layer of heat-resistant resin material, the silicone rubber layer being vulcanized after it is placed upon the layer of heat-resitant resin material. Alternatively, a layer or primer material may be used between the heat-resistant resin material and the silicone rubber layer, and the primer material must be one which promotes the adhesion of the silicone rubber to the base member or core surface.

Exemplary of silicone rubbers which may be vulcanized after a layer of the rubber is placed upon the heat-resistant resin material or the primer material, are conventional RTV, LTV or HTV silicone elastomers, and the vulcanization may be carried out according to procedures well known by those skilled in the art.

The heat-resistant material may be the polyamide resins, polyamideimide resins or polyimide resins well-known in the art. These heat-resistant resins may be formed on the base member or core by techniques well known in the art.

In accordance with the present invention it has been found that even when the fusing of toner images is carried out in a pressure contact heat fusing device while feeding a silicone oil to the heat fixing roll, the high adhesion between the roll core and the silicone rubber layer is ensured by forming on the roll core a heat-resistant layer of a polyamide resin, a polyamideimide resin or a polyimide layer, prior to the formation of the silicone rubber layer upon the heat-resistant layer or upon an optional primer layer. The resultant pressure contact heated fuser member has an extended life even though silicone oil is applied to the surface of the fuser.

These as well as other objects of the invention and further features thereof will be better understood upon reference to the following detailed description of the invention when read in conjunction with the accompanying drawings.

DESCRIPTION OF THE PREFERRED EMBODIMENTS

Figure 1:
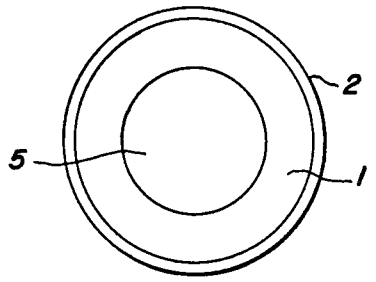
FIG. 1 represents a cross-sectional view of a conventional prior art fuser roll having a layer of self-adhesive silicone rubber formed on the core surface.

The fuser embodiments of the present invention may be used in an automatic xerographic reproducing or duplicating machine, such as the automatic xerographic reproducing machine described in U.S. Pat. No. 3,937,637, said patent being incorporated herein by reference. Therein is illustrated a reproducing machine which employs an image recording drum-like member, the outer periphery of which is coated with a suitable photoconductive material. One type of photoconductive material is disclosed in U.S. Pat. No. 2,970,906 issued to Bixby in 1961. The photoconductive drum is suitably journaled for rotation within a machine frame by means of a shaft which rotates to bring the image retaining surface thereon past a plurality of xerographic processing stations. Suitable drive means are provided to power and coordinate the motion of the various cooperating machine components whereby a faithful reproduction of the original input scene information is recorded upon a sheet of final support material such as paper or the like.

Since the practice of xerography is well known in the art, the various processing stations for producing a copy of an original are represented as stations A to E. Initially, the drum moves the photocondcutive surface through a charging station A. At charging station A an electrostatic charge is placed uniformly over the photoconductive surface of the drum preparatory to imaging. The charging may be provided by a corona generating device of a type described in U.S. Pat. No. 2,836,725 issued to Vyverberg in 1958.

Thereafter, the drum is rotated to exposure station B where the charged photoconductive surface is exposed to a light image of the original input scene information, whereby the charge is selectively dissipated in the light exposed regions to record the original input scene in the form of a latent electrostatic image. A suitable exposure system may be provided by one skilled in the art.

After exposure the photoconductive drum rotates the electrostatic latent image recorded on the photoconductive surface to development station C, wherein a conventional developer mix is applied to the photoconductor surface rendering the latent image visible. A suitable development station may include a magnetic brush development system utilizing a magnetizable developer mix having carrier granules and toner comprising electrophotographic resin plus colorant from dyes or pigments. A developer mix is continuously brought through a direction flux field to form a brush thereof. The electrostatic latent image recorded on the photoconductive surface is developed by bringing the brush of developer mix into contact therewith. The developed image on the photoconductive surface is then brought into contact with a sheet of final support material within a transfer station D and the toner image is transferred from the photoconductive surface to the contacting side of a final support sheet. The final support material may be plain paper, gummed labels, transparencies such as polycarbonate, polysulfone and Mylar, etc., as desired.

After the toner image has been transferred to the sheet of final support material, the sheet with the image thereon is advanced to a suitable fuser assembly which fuses the transfer powder image thereto. After the fusing process, the final support material is advanced by a series of rolls to a copy paper tray for subsequent removal therefrom by a machine operator.

Although most of the toner powder is transferred to the final support material, some residual toner remains on the photoconductive surface after the transfer of the toner powder image to the final support material. The residual toner particles remaining on the photoconductive surface after the transfer operation are removed from the drum as it moves through cleaning station E. Here the residual toner particles may first be brought under the influence of a cleaning corona generating device adapted to neutralize the electrostatic charge remaining on the toner particles. The neutralized toner particles are then mechanically cleaned from the photoconductive surface by conventional means as for example, the use of a resiliently biased knife blade. Other cleaning modes may be used at cleaning station E as desired by one skilled in the art.

It is believed that the foregoing description is sufficient for purposes of the present application to illustrate the general operation of a preferred automatic xerographic copier which can embody the teachings of the present invention.

As discussed above, fuser assemblies include cylindrical rolls, flat plates, curved plates, belts and the like having at least an outer surface of silicone rubber.

Figure 2:
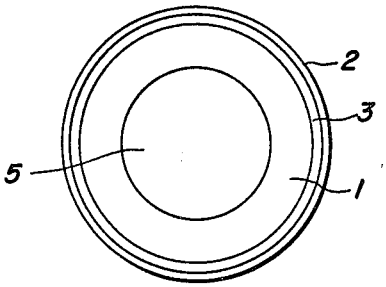
FIG. 2 represents a cross-sectional view of another conventional prior art fuser roll having a primer undercoat layer and an outer coating of silicone rubber formed and vulcanized or cured on the roll.

A typical prior art fuser roll as shown in FIG. 1, comprises fuser roll core 1 and layer 2 made of a self-adhesive RTV silicone rubber which is a heat-resistant release material place upon or formed around core 1. Numeral 5 represents a hollow core for a heating element or it may be a solid body to support the core structure 1. In FIG. 2, there is shown another prior art fuser roll which comprises fuser roll core 1, primer undercoat layer 3 and outer layer 2 of a RTV, LTV or HTV silicone rubber placed upon or formed around the outer surface of core 1 in the order shown, outer layer 4 being vulcanized after it is placed upon core 1. Numeral 5 may be the same structure as described in FIG. 1. The prior art primer material which is used for adhering silicone rubber to a roll core includes, for example, a silane having an unsaturated bond such as vinyl-trimethoxysilane, gamma-methacryloxypropyltrimethoxysilane, vinyltris(b-butylperoxy) silane and the like, or a partially hydrolyzed condensate thereof.

The present invention is described in detail with reference to FIGS. 3, 4, and 5. As shown in the drawings and preferred embodiments, the invention is described in the form of a fuser roll, however, the invention is also applicable to the fuser member configuration described above.

Figure 3:
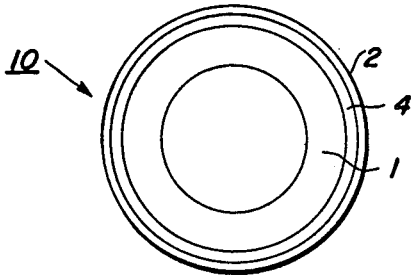
FIG. 3 represents a cross-sectional view of the fuser roll of the present invention having a heat roll core, a layer of heat-resistant resin and an outer coating of silicone rubber formed on the heat resistant resin and vulcanized after the silicone rubber is formed or coated upon the heat resistant resin layer.

According to FIG. 3 of the present invention, there is provided a fuser roll 10 which comprises a hollow heated roll core 1 (heating element not shown), a layer 4 of a heat-resistant resin composition such as a polyamide, a polyamideimide, a polyimide or combinations thereof, placed upon or formed on the surface of core 1, and outer covering layer 2 of a RTV, LTV or HTV silicone rubber placed upon or formed around layer 4, outer covering layer 2 being vulcanized after it is placed upon or formed around layer 4.

Figure 4:
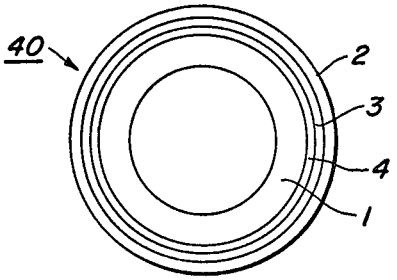
FIG. 4 represents a cross-sectional view of the fuser roll of the present invention having a heat roll core, a layer of heat resistant resin and an outer coating of silicone rubber layer formed as in FIG. 3 with a layer of primer incorporated between the silicone rubber layer and the heat-resistant resin layer.

In FIG. 4, one embodiment of the present invention is shown as incorporating a primer layer 3 between silicone rubber layer 2 and heat-resistant resin layer 4. Thus, fuser roll 40 comprises a hollow heated roll core 1 (core heating element not shown), a layer 4 of a heat-resistant resin composition such as a polyamide resin, a polyamideimide resin, or a polyimide resin formed upon roll core 1, a primer layer 3 formed upon heat resistant resin layer 4, and an outer covering layer 2 of a RTV, LTV or HTV silicone rubber placed upon or formed around primer layer 3, outer covering layer 2 being vulcanized after it is placed upon or formed around layer 3.

A number of primer materials are well-known for the adhesion of silicone rubbers to substrates, and it is within the purview of one skilled in the art to select such primers. These primers include, for example, silanes having unsaturated bonds, such as vinyltrimethoxysilane, gamma-methacryloxypropyltrimethoxysilane, vinyltris(t-butylperoxy)silane, and the like, and partially hydrolyzed products thereof. Other adhesive primers include the polysiloxane compositions disclosed and claimed as adhesive layers in U.S. patent application Ser. No. 751,825 filed Dec. 17, 1976 and assigned to the instant assignee. Therein is disclosed and claimed a polysiloxane composition intermediate the silicone rubber layer and a base member comprising:

(a) 100 Parts by weight of an organopolysiloxane expressed by the empirical formula, $R^1{}_nSiO_{(4-n/2)}$ wherein $R^1$ represents a substituted or unsubstituted monovalent hydrocarbon group, at least 80 mole percent of $R^1$ being a methyl group and having no more than 0.2 mole percent of an aliphatic unsaturated group, and $n$ is a positive numerical value of from 1.98 to 2.01, and having a viscosity greater than 100,000 centistokes at 25° C;

(b) 5 to 100 parts by weight of an organopolysiloxane expressed by the empirical formula, $R^2{}_mSiO_{(4-m/2)}$ wherein $R^2$ represents a substituted or non-substituted monovalent hydrocarbon, 3 to 25 mole percent of $R^2$ being a vinyl group, and m is a positive numerical value of from 1.9 to 2.3, and having a viscosity of from 5 to 10,000 centistokes at 25° C;

(c) 1 to 80 parts by weight of an allyl ester of a polybasic acid;

(d) 3 to 20 parts by weight of an aliphatic acid salt of a metal; and (e) 0.2 to 20 parts by weight of a silane compound expressed by the general formula, $R^3Si(OR)^4{}_3$, wherein $R^3$ represents an unsaturated hydrocarbon group and $R^4$ represents a member selected from the group consisting of a methyl group, a B-methoxyethyl group, a B-ethoxyethyl group and a tertiarybutylperoxy group. B stands for beta.

The primer composition or mixture of primer compositons may further comprise for example, finely powdered silica to improve the mechanical strength thereof, or ferric oxide or cerium oxide to improve heat resistance. To facilitate application of the primer composition onto the heat-resistant layer upon a roll core surface, suitable solvents may be added to the composition for controlling the viscosity of the composition. Examples of the solvents include benzene, toluene, xylene, trichloroethylene, perchloroethylene, methylene chloride, ethanol, isopropanol, butanol, n-hexane and the like. These solvents may be used separately or in combination with each other.

Figure 5:
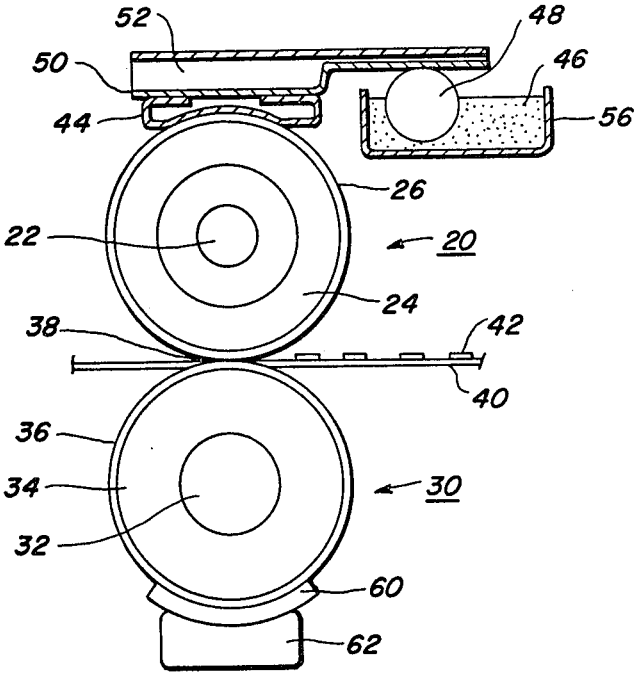
FIG. 5 is a schematic representation of a pressure contact fuser assembly which can employ the fuser members (rolls) of the present invention.

FIG. 5 shows a pressure contact heated fuser assembly having fuser roll 20 which comprises heating element 22, metal core 24 accommodating therein heating element 22, and outer layer or coating 26 made of a heat-resistant, release material placed upon or formed around metal core 24. The fuser assembly of FIG. 5 also comprises pressure roll 30 made of a heat-resistant, flexible surface material and which comprises metal core 32, silicone rubber layer 34 formed around or coated upon core 32, and polyfluoroethylenepropylene layer 36 covering silicone rubber layer 34. The fuser roll 20 and the pressure roll 30 contact and cooperate with each other by a suitable mechanism (not shown) so that a suitable pressure is applied on a nip line designated by numeral 38. Sheet 40 bearing thereon toner image 42 is passed between rolls 20 and 30. On fuser roll 30 is mounted an intermediate oil-feeding member 44 from which a silicone oil 46, on an off-set preventing liquid, is fed to the fuser roll 20 and which also serves to clean the fuser roll 20. The silicone oil 46 in sump 56 is fed to the oil-feeding member 44 through another intermediate oil-feeding member 50 by means of feeding roll 48. Indicated at 52 is a weight for pressing oil-feeding member 44 against silicone rubber layer (outer layer) 26. The pressure roll 30 is contacted with a cleaning member 60 held on a supporting member 62. the fuser roll 10 of FIG. 3 or the fuser roll 40 of FIG. 4 may be substituted for fuser roll 20 in FIG. 5, and heating element 22 may be incorporated therein if desired.

The fuser roll body or core which is suitable for coating with the layers of this invention, can be made of various kinds of metals such as iron, aluminum, nickel, chromium, copper, and the like, and alloys thereof, such as stainless steel, brass, and the like, and various synthetic resins. Of these, iron, aluminum, copper, stainless steel, brass and the like materials are preferred. One skilled in the art can select an appropriate core material.

The method of providing the necessary heat is not critical in the present invention, and the fuser members can be heated by internal means, external means or both, all heating being well known in the art for providing sufficient heat to fuse toner to its substrate.

A preferred fuser assembly comprises a heated roll structure having a hollow core. The heated roll structure includes a hollow cylinder portion thereof which is coextensive with the cylinder. The heating element may comprise any suitable type heater for elevating the surface temperature of the cylinder to operational temperatures therefor, for example, 200°–450° F. For example, it may be a quartz lamp.

In one preferred working embodiment, the resulting fuser roll structure has an outside diameter on the order of 1.5 to 3.0 inches (3.8 to 7.6 cm.) and has a length on the order of 10 to 15 inches (25.4 to 38.1 cm.). Power requirements for the foregoing are 500–2500 watts peak power with an average power of 300–2000 watts and 75–250 watts for standby. The surface temperature of the fuser member structure may be controlled by contacting the surface thereof with a thermistor probe as described in U.S. Pat. No. 3,327,096 issued to Bernous.

The pressure roll or backup roll structure which cooperates with the fuser roll structure to form a nip through which a copy paper or substrate passes such that toner images thereon contact the fuser roll structure, may comprise any suitable construction, for example, a steel cylinder, but preferably comprises a rigid steel core having a Viton elastomer surface or layer thereon. A preferred backup roll has a core approximately 1.8 inches (4.5 cm.) in diameter with a 0.1 inch (0.25 cm.) cover or layer structure of Viton elastomer or other suitable high temperature elastomeric layer structure, for example, silicone rubber and a combination of Viton or silicone rubber with Teflon thereon. Viton is the trademark of duPont Co. The specific dimensions of the members making up the backup roll will be dictated by the requirements of the particular copying apparatus wherein the fuser assembly is employed, the dimensions being greater or less depending upon the process speed of the machine.

The thickness of the silicone rubber, the heat-resistant resin layer, and/or the thickness of the layer of primer or multiple layers of any or all of the foregoing, are not critical in the practice of the present invention. Generally where the fuser member is heated by internal means, the silicone rubber the heat resistant material and the optional primer material are preferably of such thicknesses as to constitute a minimal thermal barrier to heat radiating from inside the fuser member to the outermost layer of silicone rubber. Recommended combined thickness in this case ranges from about 1 mil (0.0025 cm.) to about 200 mils (0.5 cm.), the most preferred range being about 5 mils (0.12 cm.) to about 90 mils (0.22 cm.).

The advantages of the present invention were confirmed by comparative life tests wherein several fuser rolls having different kinds of roll configurations and silicone rubbers were used and are described in detail in the Examples. The fuser rolls having the structure as described hereinbefore were placed in a pressure contact fuser assembly of the type shown in FIG. 5. The various fuser rolls were substituted in the fuser assembly after the previous roll failed.

The term "life" or "lifetime" as used herein refers to the number of reproduced copies until the heat-resistant, release layer of silicone rubber deteriorated in release characteristics resulting in off-set or winding of copying paper around the fuser roll in cases where no silicone oil is fed to the roll surface. In those tests where a silicone oil was used, the lifetime is defined as the number of reproduced copies until the heat-resistant, release layer of silicone rubber was either reduced in mechanical strength and had an irregular surface, or separated from the fuser roll core by the action of the silicone oil, which makes it impossible to continue the copying (fusing) operation. In tests where silicone oil was not used, the silicone oil-feeding system including the intermediate oil-feeding member 44, the roll 48, the silicone oil 46, the feeding roll 48, the container or sump 56 and the weight 52 were eliminated from the fuser assembly of FIG. 5.

The following examples further define, describe and compare prior art fuser rolls and fuser rolls prepared by the present invention and illustrate the preferred embodiments of the present invention.

EXAMPLE I

For comparative testing, a conventional fuser roll of the type shown in FIG. 1 was made by applying a conventional self-adhesive single liquid RTV silicone rubber identified as KE-45RTV, a product of Shinetsu Chemical Co., onto the outer surface of a degreased aluminum core 1 in a thickness of 400 microns (15.75 mils) to form a heat-resistant, release material layer 2 around the core. The fuser oil was then mounted in the fuser assembly of FIG. 5 and subjected to the above lifetime test using no silicone oil. Failure occurred when a copying sheet (paper) wound around the roll after making 470 copies (fusing 470 copies). When the above process was repeated using a silicone oil metered onto the surface of the roll, the lifetime corresponded to 3,000 copies, at which point the heat-resistant release material layer 2 was separated from the aluminum core 1.

EXAMPLE II

A fuser roll was made in accordance with the present invention for comparing with the fuser roll of EXAMPLE I. This fusing roll was fabricated according to the structure shown in FIG. 3. Using an aluminum core identical to the one described in EXAMPLE I, core 1 was first subjected to a degreasing treatment, and a heat-resistant polyimide resin (Toraneese 2000, a product of Toray Co., Ltd) was applied to the core in a dry thickness of 50 microns, followed by baking at 120° C for 3 minutes and at 240° C for an additional 15 minutes. Then the baked roll was covered with KE-45 RTV silicone rubber identical to that of EXAMPLE I to form a 400 micron heat-resistant, release layer 2 to obtain a fuser roll as shown in FIG. 3. This fuser roll was mounted in the fuser assembly of FIG. 5 for use as a heat fixing roll and subjected to the same lifetime test as in EXAMPLE I.

When no silicone oil was used, paper wound around the roll after fusing almost the same number of copies as in the case of the rolls in EXAMPLE I. Use of silicone oil in the fuser assembly prolonged the life, and a total of 9600 copies were fused using the fuser roll of this invention before the release material layer separated from the core.

EXAMPLE III

For comparative testing, another conventional fuser roll of the type shown in FIG. 2 was made by applying onto the aluminum core 1, vinylperoxysilane ($CH_2=CHSi[OOC(CH_3)_3]_3$) primer designated by numeral 3 in FIG. 2. Then 400 microns (15.75 mils) of a RTV silicone rubber identified as KE-12RTV, a product of Shinetsu Chemical Co., was applied to form a heat-resistant, release material layer 2 around the core. This fuser roll was subjected to a lifetime test in the fuser assembly of FIG. 5 without the use of any silicone oil. Failure occurred when a copying sheet (paper) wound around the roll after the reproduction of 16,500 copies.

When the above process was repeated using a silicone oil metered onto the surface of the roll, the lifetime corresponded to 4,500 copies before the heat-resistant silicone rubber layer 2 separated from the core.

EXAMPLE IV

For comparative testing another prior art roll identical to that of EXAMPLE III was made using vinylperoxysilane primer except the silicone rubber layer was formed from KE-530U HTV, a HTV silicone elastomer supplied by Shinetsu Chemical Company. This fuser roll was subjected to a lifetime test in the fuser assembly of FIG. 5.

The roll was not usable under conditions of feeding no silicone oil because toner offset occurred from the beginning. When silicone oil was fed to the roll, 6700 copies were fused before the silicone rubber layer 2 was separated from the roll core 1.

EXAMPLE V

Several heat fixing rolls of the type as shown in FIG. 4 were made according to the invention, using a heat-resistant resin layer 4, different kinds of heat-resistant resins such as a heat-resistant polyimide resin identified by the tradename Toraneese #2000; a heat resistant polyamideimide identified by the tradename Amoco AI and supplied by Amoco Chemical Co., Inc.; and a heat resistant polyimide identified by the tradename Pyer Enamel and supplied by E. I. duPont De Numours & Co. Inc., as heat-resistant releasing layer 2. Three kinds of vulcanization silicone rubbers were used, KE-13RTV, KE-53OU HTV and KE-555U HTV (products of Shinetsu Chemical Co.). The primer layer 3 was vinylperpoxysilane. The life test results using silicone oil are shown in Table I below:

TABLE I

| HEAT RESISTANT RESIN USED | Number of Copies Fused: with heat resistant silicone rubber KE-12RTV | with heat resistant silicone rubber KE-530U HTV | with heat resistant silicone rubber KE-555U HTV |
|---|---|---|---|
| Toraneese #2000 baking conditions: 120° C, 3 min and 240° C, 15 min | 42000 copies | 46000 copies | 53000 copies |
| Amoco AI Baking conditions: 200° C, 1 hr | 44000 | 46000 | 54000 |
| Skygard 700 baking conditions: 200° C, 1 hr | 42000 | 45000 | 52000 |
| Pyer enamel baking conditions: 200° C, 1 hr | 46000 | 47000 | 56000 |

As will be understood from the above results, the fuser rolls of the invention have a life several times longer than that of the prior art fuser rolls. In the foregoing examples, the fuser roll and the pressure roll each had an outer diameter of 30 mm. The silicone oil used was KF-96 350 centistokes (product of Shinetsu Chemical Co.) and its feeding rate was 0.04 cc/copy. Further, the surface temperature of the fuser roll was controlled at 160° C by changing a voltage fed to a tubular infra red lamp (rating: 100 V 1000 W) by a temperature control means (not shown). The toner employed was 2400 toner (product of Fuji Xerox Co.) and the copy paper was L-1 paper (product of Fuji Xerox Co.).

From the foregoing experimental results, it can be seen that the improved life of the fuser rolls of this invention over the prior art rolls is mainly due to early adhesion failure between the roll core and the silicone rubber layer or between the primer layer and the roll core in the prior art fusers resulting from the application of heat and from the presence of silicone oil. In the improved fuser rolls of this invention wherein a heat-resistant resin layer such as a polyamide, polyamideimide or polyimide resin is provided either between the metal roll core and the self-adhesive silicone rubber or between the metal roll core and the primer, the strengths of adhesion between the metal roll core and the heat-resistant resin layer and also between the heat-resistant resin layer and the self-adhesive silicone rubber layer, or between the metal roll core and the heat-resistant resin layer and also between the heat-resistant resin layer and the primer layer, are greater than the ahesion strength between the metal roll core and the self-adhesive silicone rubber or between the metal roll core and the primer layer.

In the practice of the invention, the silicone rubber layer may be made of a silicone rubber which has been impregnated with silicone oil since the heat-resistant resin layer has a strong adhesion even to such oil-impregnated silicone rubbers.

The fuser rolls of this invention may be used either as the fuser roll or the pressure roll in a fusing assembly of the type using two heated fuser rolls. Further, the fuser rolls may be employed in a fusing assembly having an external heating source.

As will be understood from the foregoing detailed description there is provided a fuser roll having a silicone rubber layer covering as a heat-resistant, release material strongly adhered to a metal roll core through a heat-resistant layer of a specified class of resins. The rolls of this invention are advantageous because the adhesion between the heat roll substrate and the silicone rubber layer did not fail even when a silicone oil was used as offset preventing liquid on the fuser roll, and the fuser rolls of the invention have a longer life than the prior art fuser rolls.

The silicone rubbers useful in this invention are conventional commercial rubbers described above. The silicone rubbers or elastomers may be cross-linked on the fuser member by techniques well known in the art, such as with benzoyl peroxide or other free radical initiators, with or without catalyst. Conventional techniques may be used to vulcanize the HTV, RTV, or LTV silicone rubbers on the roll surface. Conventional application of the layers to the base member can be used to form the fuser member. These techniques are well known by one skilled in the art.

While the invention has been described with respect to preferred embodiments, it will be apparent that certain modifications and changes can be made without departing from the spirit and scope of the invention and therefore, it is intended that the foregoing disclosure be limited only by the claims appended hereto.

What is claimed is:

1. A fuser member for pressure fusing electrostatic toner images at elevated temperatures comprising a base member, a layer of a heat-resistant resin material coated on the base member and at least one outer layer of a silicone rubber coated upon the layer of heat-resistant resin material.

2. The fuser member of claim 1 wherein the silicone rubber outer layer is vulcanized after it is placed upon the layer of heat-resistant resin material.

3. The fuser member of claim 1 wherein the heat-resistant resin material is a polyamide resin.

4. The fuser member of claim 1 wherein the heat-resistant resin material is a polyamideimide resin.

5. The fuser member of claim 1 wherein the heat-resistant resin material is a polyimide resin.

6. The fuser member of claim 1 further comprising a layer of primer material between the heat-resistant resin material and the silicone rubber layer, the primer material being one which promotes the adhesion of the silicone rubber to the layer of heat-resistant resin material.

7. The fuser member of claim 2 wherein the silicone rubber vulcanized upon the heat-resistant resin material is a RTV silicone rubber.

8. The fuser member of claim 2 wherein the silicone rubber vulcanized upon the heat-resistant resin material is a HTV silicone rubber.

9. The fuser member of claim 2 wherein the silicone rubber vulcanized upon the heat-resistant resin material is a LTV silicone rubber.

* * * * *